US006457341B1

(12) United States Patent
Wirgarth

(10) Patent No.: US 6,457,341 B1
(45) Date of Patent: Oct. 1, 2002

(54) FORGING DIE

(76) Inventor: Eric Wirgarth, Peter Baggegatan 2A, SE-461 40 Trollhättan (SE)

( * ) Notice: Subject to any disclaimer, the term of this patent is extended or adjusted under 35 U.S.C. 154(b) by 0 days.

(21) Appl. No.: 09/720,029

(22) PCT Filed: Jun. 21, 1999

(86) PCT No.: PCT/SE99/01115

§ 371 (c)(1),
(2), (4) Date: Jan. 18, 2001

(87) PCT Pub. No.: WO00/02683

PCT Pub. Date: Jan. 20, 2000

(30) Foreign Application Priority Data

Jun. 29, 1998 (SE) ..... 9802310

(51) Int. Cl.[7] ..... B21J 13/02
(52) U.S. Cl. ..... 72/354.2; 72/355.4
(58) Field of Search ..... 72/354.2, 354.6, 72/354.8, 355.2, 355.4, 355.6, 357

(56) References Cited

U.S. PATENT DOCUMENTS

| | | | | |
|---|---|---|---|---|
| 2,174,970 A | * | 10/1939 | Cornell, Jr. | 72/355.6 |
| 2,417,569 A | * | 3/1947 | Rice | 72/354.8 |
| 3,280,613 A | * | 10/1966 | Schrom | 72/359 |
| 4,015,461 A | | 4/1977 | Schober | 72/358 |
| 4,372,144 A | | 2/1983 | Valentine et al. | 72/352 |
| 4,667,394 A | * | 5/1987 | Bode et al. | 72/355.4 |
| 1,335,908 A | * | 4/2000 | Mueller | 72/354.2 |

FOREIGN PATENT DOCUMENTS

| | | | | |
|---|---|---|---|---|
| GB | 1 340 486 | | 12/1973 | |
| JP | 58-41643 A | | 3/1983 | |
| JP | 58-41643 | * | 3/1983 | 72/354.2 |

OTHER PUBLICATIONS

International Preliminary Examination Report dated Oct. 4, 2000.
International Search Report dated Oct. 19, 2000.

* cited by examiner

*Primary Examiner*—Lowell A. Larson
(74) *Attorney, Agent, or Firm*—Burns, Doane, Swecker & Mathis, LLP

(57) ABSTRACT

The invention relates to a forging apparatus used for forging a heated blank (24*a*), which in a pre-treated operation has been given a volume essentially corresponding to that of the final product, said forging apparatus comprising upper and lower die parts (2, 16) arranged to be brought together into abutting relationship and having contacting surfaces (42*a*, 18*b*) extending transversely of the direction of movement of the die parts, whereby when the contacting surfaces (42*a*, 18*b*) are pressed together and brought into contact with one another as result of pressure exerted thereon, the blank is shaped in conformity with a die cavity defined with precision by the die parts (2, 16). The configuration of the forged component then essentially agrees with that of the desired finished component, i.e. no or at least only minimum post-treatment is required. Said contacting surfaces (42*a*, 18*b*) extending transversely of the direction of movement of the die parts are arranged to have no contact with the die cavity (25) during the forging operation.

17 Claims, 7 Drawing Sheets

FORGING DIE

TECHNICAL FIELD

The invention relates to a pressing die used for forging a heated blank, which in a pre-treatment operation has been given a volume essentially corresponding to that of the final product. The forging apparatus comprises upper and lower die parts arranged to be displaced towards each other and having contacting surfaces extending transversely of the direction of movement of the die parts, whereby when the contacting surfaces are pressed together and brought into contact with one another as a result of pressure exerted on said parts, the blank is shaped in conformity with a die cavity defined with precision by the die parts. The configuration of the thus forged component then essentially agrees with that of the desired finished component, i.e. no or at least only minimum post-treatment is required.

TECHNICAL BACKGROUND

A device of the kind described above is previously known from U.S. Pat. No. 4,015,461. The forging apparatus described therein comprises two parts which are pressed against one another until the surfaces thereon that extend transversely of the direction of pressure exertion are brought into contact with one another. A die cavity having a carefully defined volume is thus defined, and the blank to be forged has been pre-treated so as to adopt that volume for the purpose of eliminating the need for post-treatments.

One problem encountered with this kind of forging dies is that during the forcing operation, material might be forced out from between the contacting surfaces, with the result that so called burrs may form on the component, making the undesired post-treatment necessary after all. At worst, the amount of material being expelled from between the contacting surfaces is of such a magnitude as making completion of the forging operation impossible.

Another problem encountered with forging dies of the kind outlined above is that they cannot be used for forging components having a more complex configuration, such as a cylinder having outwardly projecting fins or other protrusions thereon. It would be impossible to remove components of such a shape from a die of this kind.

It should be noted that by the expression "cylinder" as used in this context is intended a surface obtained by moving a straight line in parallel along a curve, such as an ellipse or a circle.

SUMMARY OF THE INVENTION

A first object of the present invention is to provide a forging apparatus, which is adapted satisfactorily to eliminate or to reduce to a minimum the need of post-treatment of the forged component.

A second object of the present invention is to provide a forging apparatus to be used to forge components having a more complex configuration.

A third object of the present invention is to provide a forging apparatus making an efficient manufacturing process possible.

The first one of these objects is achieved in accordance with the teachings of the invention in that such contacting surfaces that extend transversely of the direction of movement of the die parts and are mutually movable during the forging operation have no contact with the die cavity during the forging operation. This means that the material of the blank confined inside the die cavity during the forging operation cannot be squeezed out from between the contacting surfaces.

Furthermore, the forging apparatus preferably comprises a plurality of die members arranged to be displaced towards and away from the die cavity center and to be locked in their bought-together position in which they define the die cavity laterally. The fact that the members that define the die cavity radially, that is towards and away from the die cavity center, are arranged for radial movement means that during the forging operation the component is allowed to completely fill voids in the die members, and to thus form components having a comparatively complex shape. After the forging operation, the die members may be moved apart, thus allowing removal of the forged component.

Power-exerting means preferably are interconnected with the die members and arranged to move said members towards and away from the die center. Said power-exerting means are able to effect the pressing-together of the die members prior to the start of the forging operation, and to thereafter move said means apart after completion of the forging operation.

Preferably, the die members may be locked by a locking ring. The locking ring ensures even distribution of the radial pressure around the circumference of the entire die cavity in the course of the forging operation.

Preferably, the die parts may be displaced towards one another in a two-step operation, that is a first step, during which the locking ring is brought into contact with the die members, locking them in their brought-together position, and a second step, during which the blank is shaped in conformity with the die cavity, the configuration of which is precision defined by the die parts. This arrangement provides for a smooth forging process, wherein locking of the die cavity and the forging operation are effected in one and the same movement.

In accordance with a special embodiment of the die the die parts are arranged to be vertically spring-actuated. In consequence of this arrangement, the upper and the lower ends of the blank may be deformed simultaneously. This possibility is particularly advantageous for instance when fins or flanges are to be formed at the upper and the lower rim of the blank, or when multi-arm components, such as for instance cross members for universal joints are to be manufactured.

Other characterizing features of the invention will be apparent from the appended claims and will be described in the ensuring description of three presently preferred embodiments of the invention.

BRIEF DESCRIPTION OF THE DRAWING FIGURES

Three embodiments of the forging apparatus in accordance with the invention will be described in the following with reference to the accompanying drawings, wherein FIG. 1*a* is a cross-sectional view of a first embodiment of the die in accordance with the invention, the die being shown in the initial position, and with a blank being inserted between the die members.

FIG. 1*b* is a cross-sectional view of a first embodiment of the die in accordance with the invention, the die being shown in the final position, and the blank having been shaped into the desired configuration.

Figures 4A, 4B:
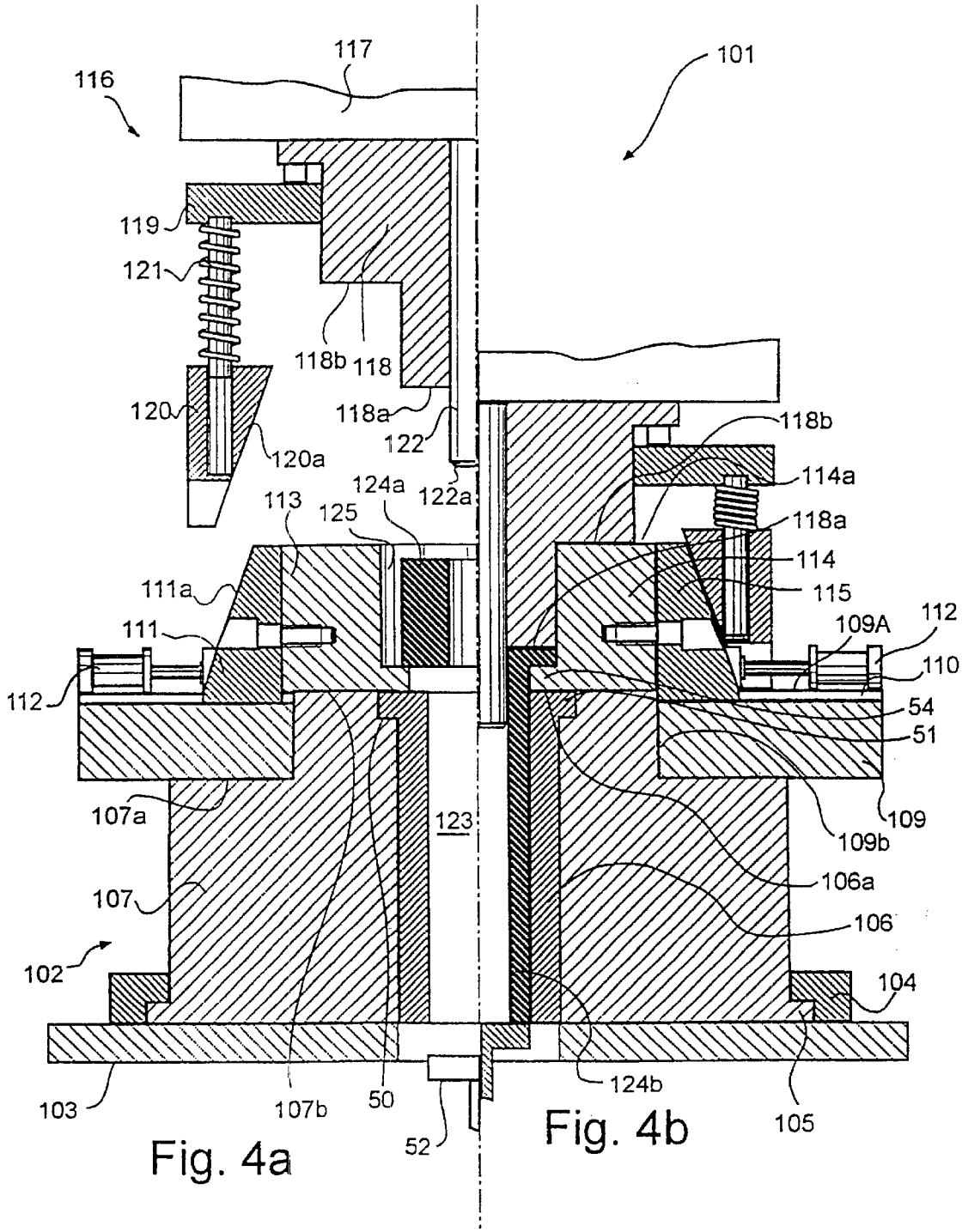

FIG. 4*a* is a cross-sectional view of a second embodiment of the die in accordance with the invention, the die being shown in the initial position, and with a blank positioned between the die members.

FIG. 4*b* is a cross-sectional view of a second embodiment of the die in accordance with the invention, the die being shown in the final position and the blank having been shaped into the desired configuration.

Figure 5:
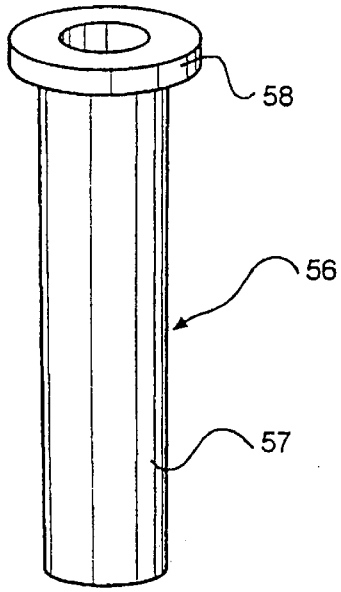
Figure 6:
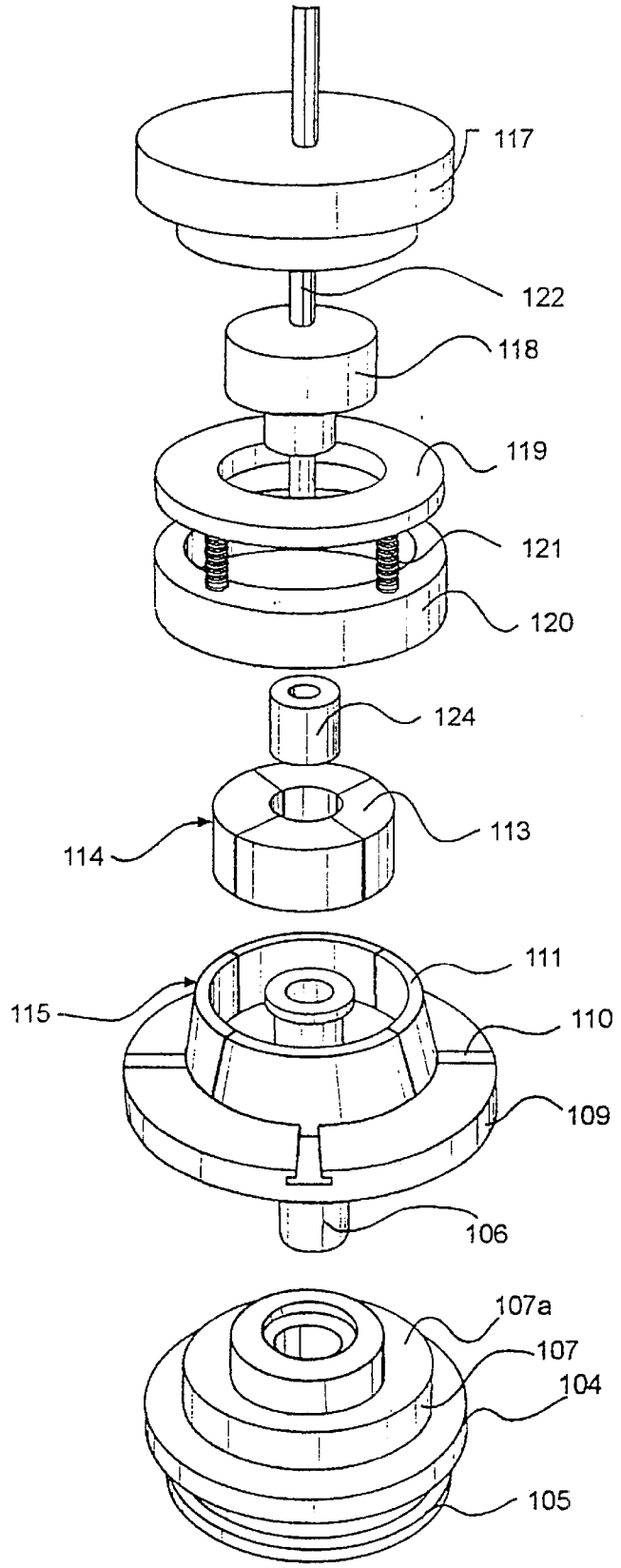

FIG. 5 shows a component shaped by means of the die in accordance with FIGS. 4*a*, 4*b*, FIG. 6 is an exploded view of the die in accordance with FIGS. 4*a*, 4*b*.

Figures 7A, 7B:
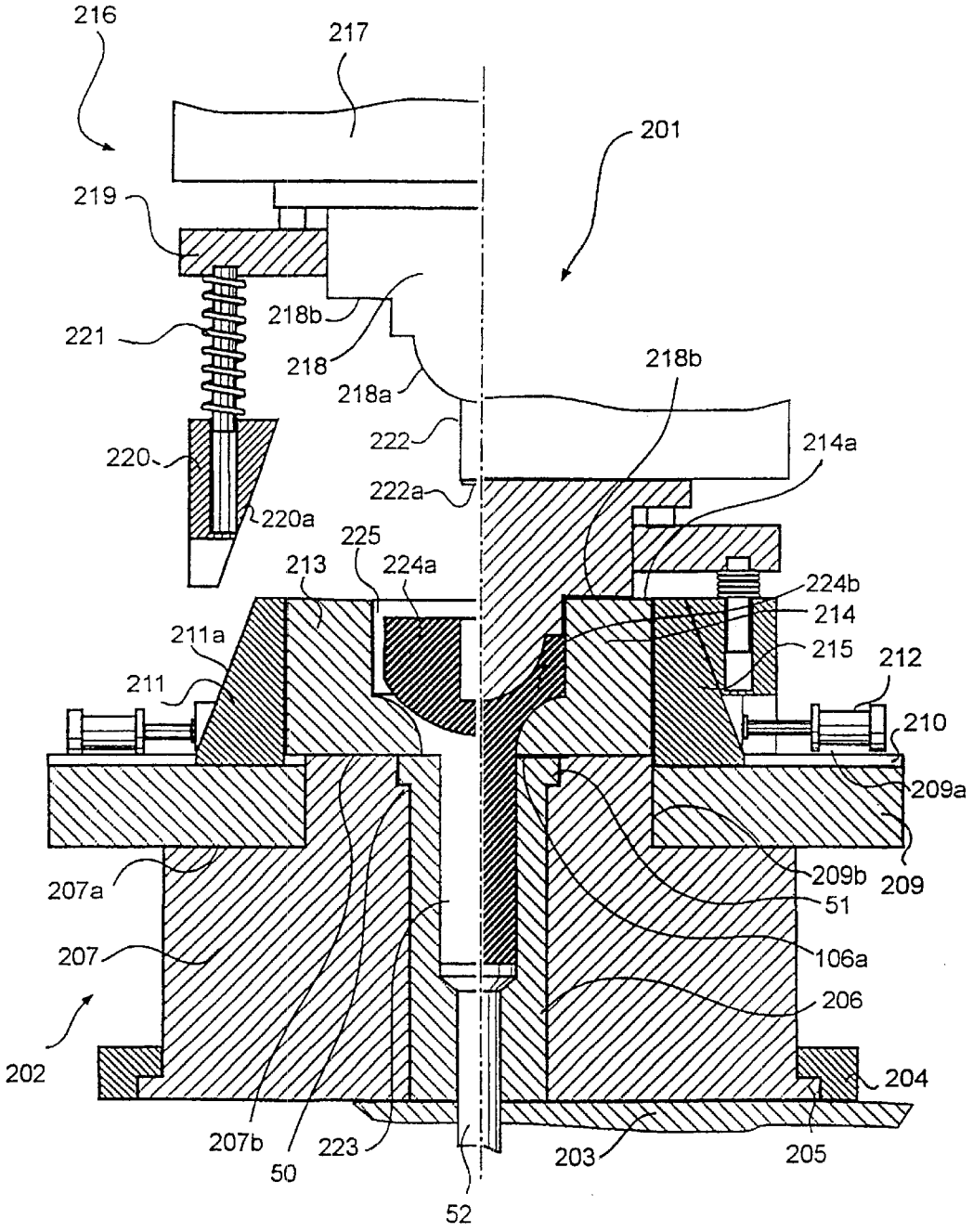

FIG. 7*a* is a cross-sectional view of a third embodiment of the die in accordance with the invention, the die being shown in the initial positoin, and with a blank positioned between the die members.

FIG. 7*b* is a cross-sectional view of a third embodiment of the die in accordance with the invention, the die being shown in the final position and the blank having been shaped into the desired configuration.

Figure 9:
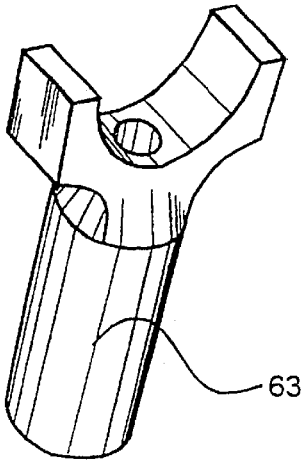
Figure 8:
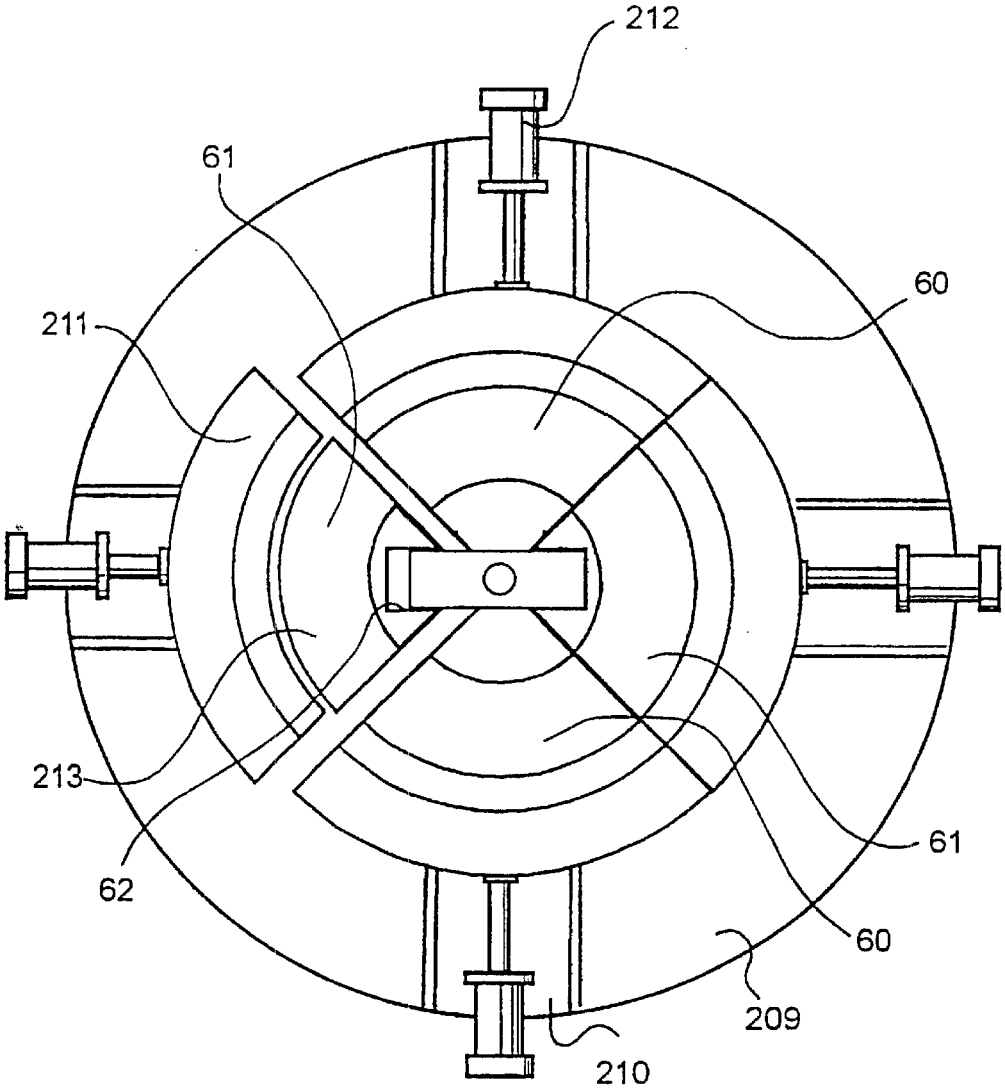

FIG. 8 is a view from above showing the die jaws incorporated in the die in accordance with FIGS. 7*a*, 7*b*, and FIG. 9 shows a component shaped by means of the die in accordance with FIGS. 7*a*, 7*b*.

DETAILED DESCRIPTION OF THE PREFERRED EMBODIMENTS

Figures 1A, 1B:
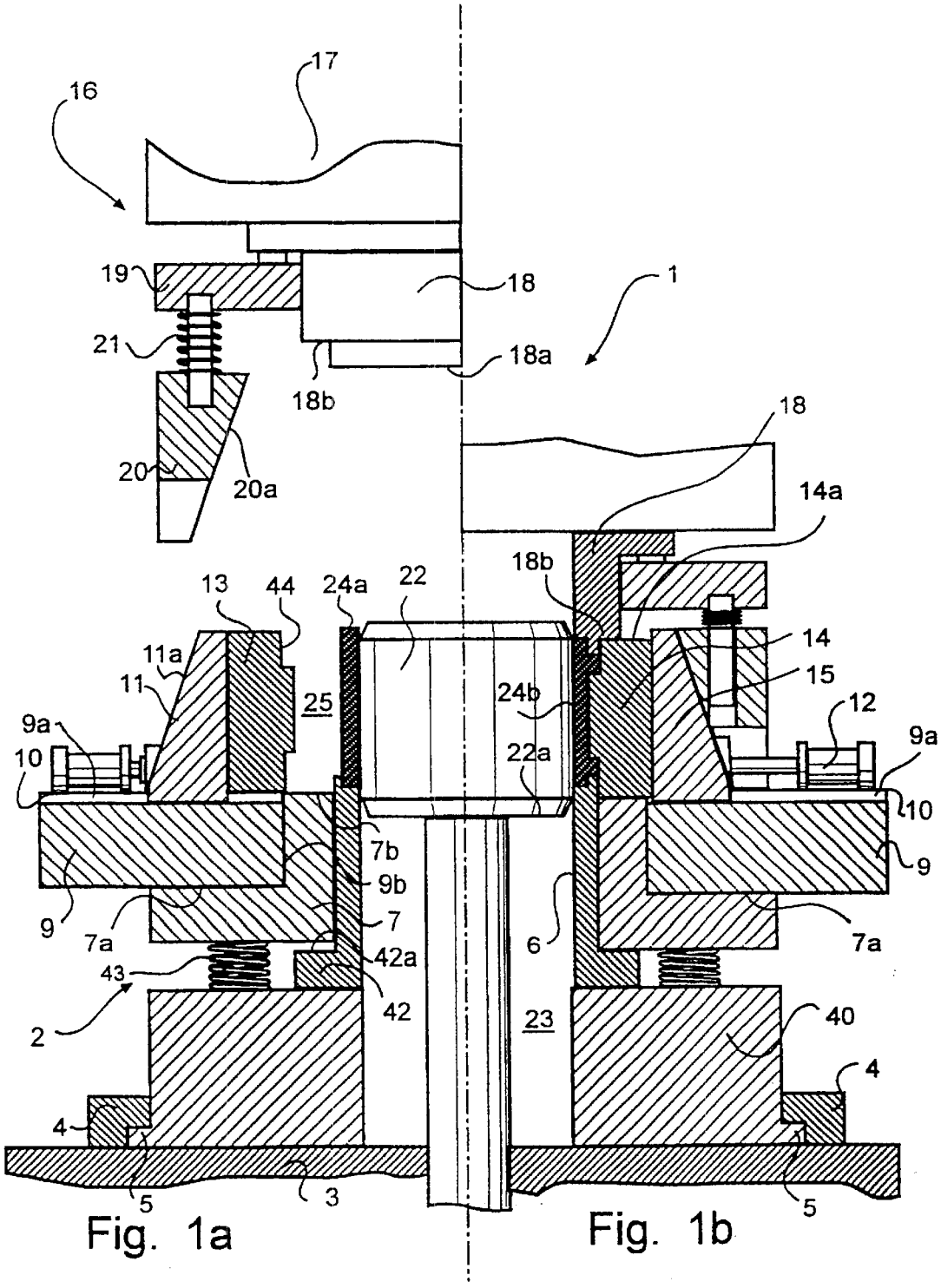

FIGS. 1*a*, 1*b* illustrate a first embodiment of the forging apparatus in accordance with the invention, generally designated by reference numeral 1. The lower die part 2 comprises a lower cylinder-shaped die holder 40, which is fixedly mounted on the support 3, preferably with the aid of a lower locking ring 4, which grips a flange 5 formed at the lower edge of the die holder 40.

An abutment member 6, in this case essentially consisting of a cylinder, is arranged coaxially on the cylindrical die holder 40. The inner diameter of the abutment member 6 essentially coincides with the inner diameter of the die holder 40. An outwardly directed flange is formed at the lower edge of the cylindrical abutment member 6.

An annular pad 7 formed with an external shoulder 7*a* is mounted around the abutment member in abutting relationship therewith, the inner diameter of said annular pad essentially agreeing with the external diameter of the abutment member 6. The pad 7 is resiliently supported by the die holder 40, preferably by means of a plurality of spring means 43, whereby the pad 7, in an unloaded condition, will be kept spaced from the die holder 40 but when exposed to a load of a predetermined magnitude, preferably exceeding 10 tons, the pad will be depressed into abutting relationship with an abutment face 42*a* formed between the pad 7 and the die holder 3. Preferably, the abutment face 42*a* is the above-mentioned flange 42 formed at the lower edge of the abutment member.

The external shoulder 7*a* of the pad 7 supports an annular grooved disk 9 the upper face 9*a* of which is level with the upper face 7*b* of the pad and the inner face 9*b* of which abuts against the external face of the external shoulder 7*a* of the pad.

The grooved disk 9 is formed with a pluralilty of radially undercut grooves 10, in the present case in the number of four grooves, which in accordance with the shown example run transversely across the upper face 9*a* of the entire grooved disk 9. In each groove 10 a holder 11 is received for movement in said groove, the outer face 11*a* of the holder 11 sloping downwards and outwards away from the center of the die. Power-exerting means 12 are arranged at each holder for the purpose of displacing the holders 11 along the grooves 10. A die jaw 13 is positioned interiorly of each holder and arranged in such a manner that the die jaws are pressed together when the power-exerting means 12 displace the holders inwards along the grooves 10. Recesses 44 the shape of which corresponds to the desired appearance of the forged component 45 are formed on the inner face of the die jaws 13. Each holder 11 and each die jaw 13 are configured as a sector of a ring, such that when pressed together they form two essentially continuous concentric rings, which may be designated a die ring 14 and a holder ring 15, respectively (see FIG. 1*b*). The lower face 14*b* of the die ring 14 has a width radially that essentially equals the width of the upper face 7*b* of the pad.

In accordance with the first embodiment, the upper die part 16 of the forging apparatus 1 essentially consists of the vertically movable pressing head 17, on which a punch 18 is mounted. In this case the punch 18 essentially consists of a cylinder, the inner diameter of which equals that of the abutment member 6. The punch 18 is formed with an abutment face 18*b*, allowing the punch 18 to be lowered into the die ring 14 until the abutment face 18*b* contacts the die ring 14, in which position the lower face 18*a* of the punch is located below the upper face 14*a* of the die ring.

The punch likewise supports a thrust collar 19 arranged concentrically thereon, and a locking ring 20 is resiliently mounted on the collar, preferably by means of a number of spring means 21, whereby the locking ring, in an unloaded condition, will be kept spaced from the thrust collar 19 but when exposed to a load of a predetermined magnitude, preferably exceeding 10 tons, the locking ring will be urged over a predetermined distance towards the thrust collar. The inner face 20*a* of the locking ring 20 slopes at such an angle that its inclination corresponds to that of the outer face 11*a* of the holders 11, whereby when the locking ring 20 is being pressed downwards over the holder 11, the latter will be forced inwards, along the grooves 10, and consequently will press the die jaws 13 together.

The contacting surface 11*a*, 20*a* between the holders 11 and the locking ring 20 preferably is self-locking, that is, the inclination is so adapted to the coefficient of friction that a lateral force will not generate a vertical force that might cause a movement in that direction.

Finally, the die in accordance with the first embodiment preferably comprises a preferably solid mandrel 22 of cylindrical shape, which is arranged to move upwards through the channel 23 formed by the die holder 40, the abutment member 6, the die laws 13 and the punch 18. For instance means (not shown) to move the mandrel upwards are located underneath the support 3. The external diameter of the mandrel 22 essentially equals that of the abutment member 6 and the internal diameter of the punch 18, and the mandrel height at least equals that of the die jaws 13.

The blank 24*a* to be pressed into shape by means of the die in accordance with the first embodiment is a cylinder which has been lathe-turned into predetermined dimensions, suitable to a tolerance of ±0.1 mm, preferably ±0.05 mm. The dimensions of the cylinder are such as to allow the mandrel to be introduced into a space 25, which is delimited by the mandrel 35 and the die ring 14 laterally and by the abutment member 6 at the bottom. The blank 24*a* also is heated to at least 650° C., preferably to between 1200° C. and 1300° C.

In use of the forging apparatus, the mandrel 22 is moved upwards, through the die holder 40 and the abutment member 6 and is positioned level with the die jaws 13 and the holders 11, whereupon the treated and heated blank 24*a* is applied on the mandrel 22. The power-exerting means 12 urge the holders 11 inwards, along the grooves 10, the holders pushing the die jaws 13 in front of themselves, whereby the above-mentioned die ring 14 is formed and retains the blank 24*a* in abutment against the mandrel 22. The pressing head 17 is then lowered towards the support 3 in a two-step operation.

In the first step, the locking ring 20 is carried downwards, over the holders 11, causing the die ring 14 to be pressed additionally together and to be locked in that position. In addition, the punch 18 is moved into contact with the blank 24*a*.

In the second step, the punch 18 is forced downwards into the blank 24*a*, deforming the latter, while at the same time the spring means 21, 43, interposed between the die holder 40 and the pad 7 and between the thrust collar 19 and the locking 20, respectively, are compressed. In consequence hereof, the blank is compressed vertically and fills out the recesses 44 formed in the die jaws, and eventually it adopts precisely the shape of the die cavity defined by the mandrel 22 and the die ring 14 radially and by the abutment member 6 and the mandrel 18 axially.

When the pressing head 17 reaches its lowermost position, it is returned to its original position, bringing along the locking ring 20, which releases its grip on the holders 11 and the die jaws 13. The holders are moved apart by the power-exerting means and the mandrel 22 is lowered, leaving the finished forged component 24*b*, 45 resting in an unconstrained condition on the abutment member 6.

Figure 3:
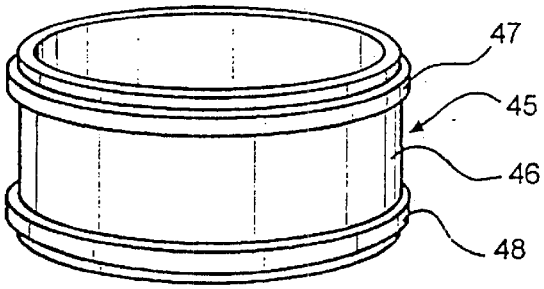
FIG. 3 shows a component shaped by the die in accordance with FIGS. 1*a*, 1*b*.

The finished component 24*b* (most clearly apparent from FIG. 3, bearing numeral reference 45), which issues from the forging apparatus in accordance with the embodiment shown in FIGS. 1*a*, 1*b*, consists of an essentially cylindrical body 46 formed with one upper and one lower flange 47 and 48, respectively.

FIGS. 4*a*, 4*b* illustrate a second embodiment of the forging apparatus in accordance with the invention, generally designated by numeral reference 101. The lower die part 102 of the forging apparatus comprises a pad 107 having a cylindrical configuration and being securely mounted on the support 103, preferably by means of a locking ring 104 which securely grips a flange 105 formed at the lower edge of the pad. At its top, the pad is provided with inner and outer shoulders, 50 and 107*a*, respectively.

An abutment member 106, in the present case essentially in the shape of a guide sleeve 106 configured as a cylinder, is arranged interiorly of the pad 107. The upper rim of the guide sleeve advantageously is formed with an outwardly directed flange 51, which rests on and fills the inner shoulder 50 of the pad. An ejector 52 delimits the die cavity at the bottom and is arranged to be moved from below, upwards through the guide sleeve 106. For instance, means (not shown) could be provided underneath the support 103 to cause the ejector 52 to move upwards.

The outer shoulder 107*a* of the pad 107 supports an annular grooved disk 109 formed with a plurality of radial undercut grooves 110, in the present case in the number of four, which grooves in accordance with the shown example run transversely across the upper face 209*a* of the entire grooved disk. The upper face 209*a* of the grooved disk, the upper face 107*b* of the pad, and the upper face 106*a* of the guide sleeve are level with one another and consequently jointly form a flat surface having a centrally located, vertical channel 123.

Each groove 110 of the grooved disk 109 receives a holder 111 for movement therein, the outer face 111*a* of said holder 111 sloping in a direction downwards and outwards from the center of the die. A power-exerting means 112 is provided at each holder 111, said means arranged to displace the holder 11 along the groove 110. Interiorly of each holder 111 there is arranged a die jaw 113 arranged to press the die jaws 113 together as the holders 111 are moved inwards, along the grooves 110. Each holder 111 and each die jaw 113 is configured as a sector of a ring, such that when pressed together they form two essentially continuous and concentric rings, which may be designated die ring 114 and holder ring 115. In accordance with this embodiment, the die ring 114 is formed with an inwardly directed flange 54 which in the pressed-together position has an interior diameter which essentially equals the interior diameter of the guide sleeve 106.

The upper die part of the forging apparatus in FIGS. 4–5 essentially consists of the vertically movable pressing head 117 to which the punch 118 is attached. In this case, the punch 118 is a cylinder having an essentially flat bottom face 118*a* and an internal diameter, which is smaller than the internal diameter of the guide sleeve 106, and an external diameter, which essentially equals the interior diameter of die ring 114. Furthermore, the punch 118 is formed with a shoulder 118*b*, whereby the punch 118 may be lowered into the die ring 114, until the abutment 118*b* abuts against the die ring 114, in which position the lower face 118*a* of the punch 118 is spaced somewhat above the inwardly directed flange 54 of the die ring 114.

The pressing head 117 likewise supports a solid, cylindrical mandrel 122, which is vertically movable. The exterior diameter of the mandrel 122 essentially equals the interior diameter of the punch 118.

The pressing head 117 likewise supports a thrust collar 119 arranged concentrically with the punch 118, and the locking ring 120 is resiliently mounted on the collar, preferably by means of a number of spring means 121, whereby the locking ring 120, in an unloaded condition, will be kept spaced from the thrust collar 119 but when exposed to a load of a predetermined magnitude, preferably exceeding 10 tons, the locking ring will be urged over a predetermined distance towards the thrust collar 119. The inner face 120*a* of the locking ring 120 slopes at such an angle that its inclination corresponds to that of the outer face of the holders 111, whereby when the locking ring 120 is being pressed downwards over the holders 111, the latter will be forced inwards, along the grooves and in consequence thereof press the die jaws 13 together.

The contacting surface 111*a*, 120*a* between the holders 111 and the locking ring 119, preferably is self-locking, that is, the inclination is so adapted to the coefficient of friction that a lateral force will not generate a vertical force that might cause a movement in that direction.

The blank 124*a* to be forged by means of the die in accordance with the second embodiment of the invention is in the form of a cylinder 124*a* which has been severed from a turned rod. The dimensions of the cylinder 124*a* are such as to allow it to be introduced into a space 125 formed between the mandrel 122 and the die ring 114. In addition, the blank is heated to at least 650 degrees, preferably to between 1200 and 1300 degrees.

In use of the forging apparatus 1, the blank 117*a* is placed centrally in the space 125 between the die jaws 113, whereupon the mandrel 122 is moved downwards, through the blank 124*a* until the lower face 122*a* of the mandrel 122 assumes a position below the upper face 106*a* of the guide sleeve 106. The power-exerting means 112 urge the holders 111 inwards, along the grooves 110, the holders pushing the die jaws 113 in front of themselves, whereby the above-mentioned die ring 114 is formed and retains the blank in abutment against the mandrel 122, whereafter the pressing head 117 is lowered towards the support 103 in a two-step operation.

In the first step, the locking ring 120 is carried downwards, above the holders 111, causing the die ring 114 to be pressed additionally together and to be locked in that position.

In the second step, the punch 118 is pressed downwards into abutment against the blank 117*a*, while at the same time the spring means 121, interposed between the thrust collar 119 and the locking ring 120, are compressed. In consequence hereof, the blank 117*a* is compressed axially, and material is being forced down through the annular aperture that has formed between the mandrel 122 and the guide sleeve 106, flowing along the interior wall of the guide sleeve 106. The forging operation is completed, when the upper part of the punch 118 abuts against the die ring, and when this happens a component 124*b* (most clearly illustrated in FIG. 5 and bearing numeral reference 56) has been formed, configured as a cylinder 57 having an outwardly directed flange 58 at its upper end.

Following the completion of the forging operation, the mandrel 122 is lifted out of the forged component 124*b*, whereupon the pressing head 117 is returned to its original position, bringing along the locking ring 120, which releases the holders 111 and the die jaws 113. The holders 111 are moved apart by the power-exerting means and the ejector 52 is carried upwards, through the guide sleeve 106, and pushes the forged component 124*b*; 240 upwards.

In accordance with an alternative use of the forging apparatus in accordance with the second embodiment, the mandrel 122 is carried upwards and shortly before completion of the forging operation, it is arrested in a position, wherein its lower end 122*a* is level with the lower face 118*a* of the punch 118. Upon continued pressing, the material is forced radially inwards, along the lower face 118*a* of the punch 118, closing the cylinder that has been shaped in the forging operation. The finished component thus is given the shape of a cylinder having an outwardly directed flange at one of its ends, which furthermore is a closed end.

FIG. 6 is an explosive view of the second embodiment of a forging apparatus in accordance with the invention and merely intends to illustrate the relative orientation of the various parts and their relationship. The drawing figure is essentially applicable also to the other two embodiments, even though some details are different. For example, the spring arrangement with respect to pad 6 of the first embodiment of the forging apparatus is not shown.

Figure 2:
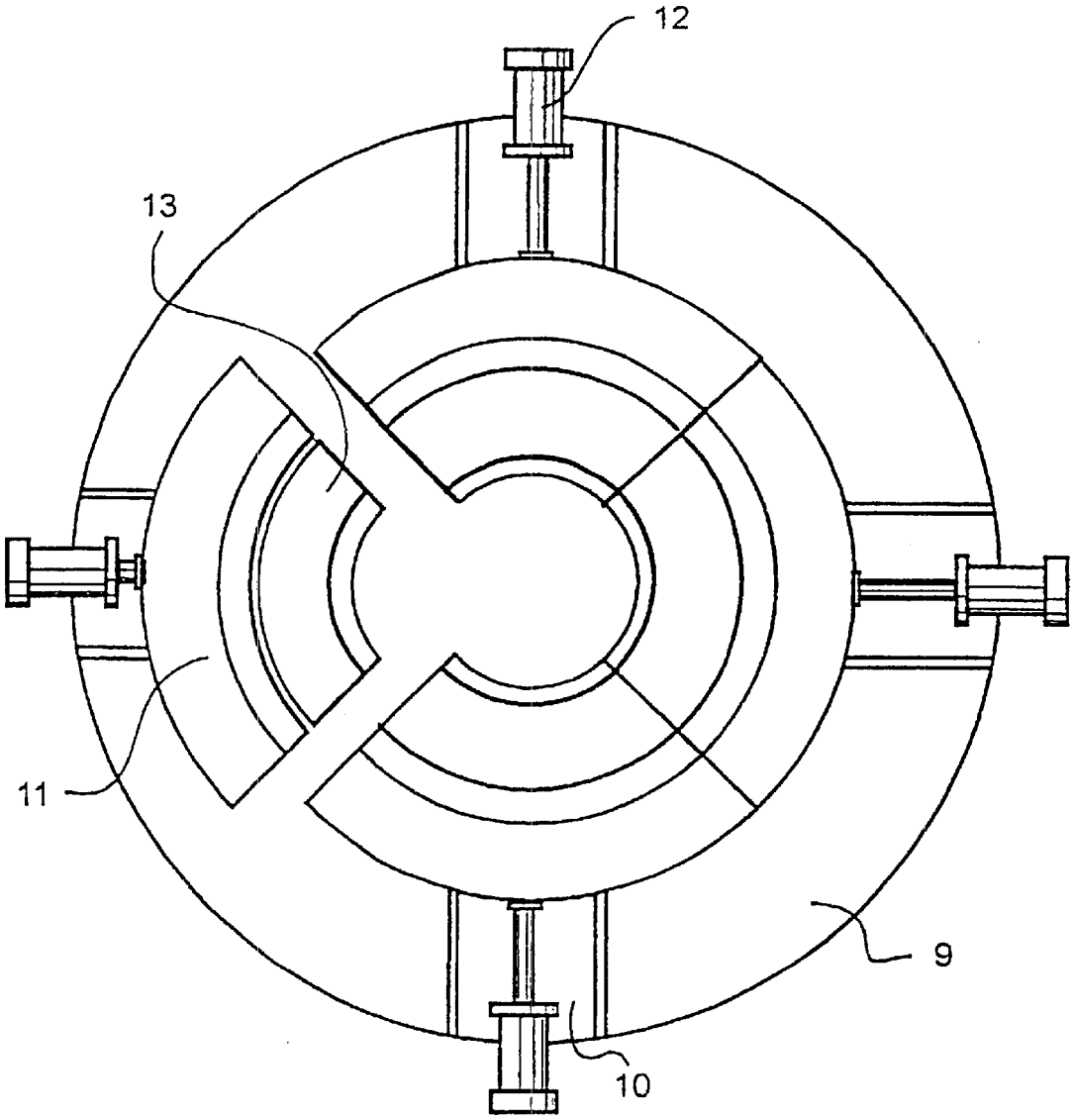
FIG. 2 is a view from above of the die jaws incorporated in the die in accordance with FIGS. 1*a,* 1*b*.

The forging apparatus in accordance with the third embodiment is shown in FIGS. 7*a*, 7*b*. The parts incorporated therein essentially are the same as in the die according to the second embodiment and therefore have been given the same numeral references as in treat embodiment, The essential difference between the dies of the second and third embodiments lies in the extension of the die cavity in the cross-pressing direction, as best illustrated in FIGS. 2 and 8, respectively, and in the configuration of the punch.

Like in previous embodiments, the die jaws 213 of die 201 according to the third embodiment essentially are configured as sectors of a circle, such that when in their brought-together position, they form a die ring 214. However, in this case the space 225 at the center of the ring is essentially rectangular and is formed by two oppositely positioned jaws 60, which have been cut off in the direction towards the center whereas the remaining two jaws 61 are formed with rectangular recesses 62 in the direction away from the center (see FIG. 8).

The punch 218 is configured to fit the rectangular space 225 and otherwise it possesses the same characteristics as does the punch 118 in accordance with the second embodiment of the die.

The blank 224*a* to be forged by means of the die 201 in accordance with the third embodiment also has a shape allowing it to be introduced into the rectangular shape 225.

In use of the forging apparatus 201 the blank 224*a* is placed centrally in the space 225 between the die jaws 213, whereupon the holders 211 are displaced inwards, along the grooves 210, by the power-exerting means 212, pushing the die jaws 213 in front of themselves in the direction towards the center of the space 225, such that the die ring 214, having the rectangular center space, is formed.

The forging operation starts by the mandrel 222 being lowered, until its lower faces 222*a* assumes a position below the upper face 206*a* of the guide sleeve 206, and in doing so urges part of the blank 224*a* in front ot itself. Thereafter, the pressing head 217 is lowered in a two-step operation as has been described earlier.

As material is being forced down through the annular opening, along the interior wall of the guide sleeve 206, the part of the blank that has been depressed by the mandrel 222 is pressed downwards. When the forging operation has come to its end, that is when the abutment face 218*b* of the punch abuts against the die ring 214, said part of the blank has been shaped against the ejector 52 in the lower part of the guide sleeve 206, and a component 224*b* having a closed-end cylindrical portion at its lower end, has been formed. The lower face 218*a* of the punch and the inwardly direction flange 54 of the die ring 214 could for example be configured in such a manner that the component 24*b* (best shown in FIG. 9, bearing numeral reference 63) may be used as a connecting rod.

The tolerances of the parts of the dies described above are such that no material will be pressed into the joints between the various parts during the forging operation. This means that the forged component 24*b*, 224*b*, 324*b* does not exhibit faults such as so called burrs or the like, and therefore may be used directly, or at least after only minor post-treatment, such as e.g. fine smoothing.

It should be appreciated that the invention as defined in the appended claims is not limited to the preferred embodiments described above.

For example, the directions of reference, such as lower face, upper face, upwards, downwards, radially, axially, and so on are intended to relate to the drawing figures only. Obviously, the die could equally well extend in the horizontal plane and the parts of the die could be positioned differently relative to one another than shown and described.

The number of grooves in the grooved disk could vary, and although three or more grooves are preferred, also two grooves are able to produce the desired effect. Actually, the provision of one single groove is conceivable, in which case one of the die jaws is stationary while the other one is movable.

In the forging operation, the die jaws may be moved by the locking ring over the very last part towards the center when the punch has already been carried somewhat down between the die jaws. This arrangement would make possible a tighter or closer abutment between the external sides of the punch and the die ring.

What is claimed is:

1. A forging apparatus for forging a heated blank, the blank having a volume essentially corresponding to a volume of a final product, comprising:

upper and lower die parts, at least one of the die parts being arranged to be displaced toward the other one of the die parts to form a closed die cavity and each of the die parts exerting pressure on a blank to form a forged component shaped in conformity with a final die cavity shape during a forging operation, the die parts including at least one contacting surface extending transversely of a direction of movement of the die parts, the at least one contacting surface abutting at least one other surface to limit displacement of the at least one of the die parts when the at least one of the die parts is displaced toward the other one of the die parts, wherein the upper and lower die parts and the at least one contacting surface and the at least one other surface are arranged such that, after the at least one of the die parts is displaced to form the closed die cavity, the at least one of the die parts continues to be displaced until the at least one contacting surface abuts the at least one other surface, the at least one contacting surface and the at least one other surface being disposed remote from the closed die cavity;

a cylindrical mandrel extending through the upper die part and adapted to be received in the closed die cavity;

means for displacing the mandrel relative to the upper die part so that the mandrel and the closed die cavity define an annular gap;

wherein, during a forging operation, the final die cavity shape is defined by part of the at least one of the die parts and a fixed part of the other one of the die parts, when the at least one of the die parts is displaced until the at least one contacting surface and the at least one other surface abut, and by the mandrel and the blank is pressed into the annular gap.

2. A forging apparatus as claimed in claim 1, wherein the die parts comprise a plurality of displaceable die members adapted to be displaced towards and away from a center of the die cavity and to be locked in a brought-together position in which they define lateral portions of the final die cavity shape.

3. A forging apparatus as claimed in claim 2, further comprising power-exerting means associated with the displaceable die members for moving the displaceable die members towards and away from the center of the die cavity.

4. A forging apparatus as claimed in claim 3, wherein the displaceable die members are configured as sectors of an ellipse and, when brought together, the displaceable die members form a ring.

5. A forging apparatus as claimed in claim 3, further comprising a locking ring for locking the displaceable die members.

6. A forging apparatus as claimed in claim 2, wherein the displaceable die members are configured as sectors of an ellipse and, when brought together, the displaceable die members form a ring.

7. A forging apparatus as claimed in claim 6, wherein the die parts are displaceable towards one another in a two-step operation and, in a first step, a locking ring locks the displaceable die members in the brought-together position, and, in a second step, during which other die members are displaced and the blank is shaped in conformity with the final die cavity shape.

8. A forging apparatus as claimed in claim 7, wherein the displaceable die members are vertically spring-actuated and in the second step a pressing head is arranged to press the displaceable die members in a direction of an axis of the closed die cavity against an abutment against the spring action.

9. A forging apparatus as claimed in claim 6, further comprising a locking ring for locking the displaceable die members.

10. A forging apparatus as claimed in claim 2, further comprising a locking ring for locking the displaceable die members.

11. A forging apparatus as claimed in claim 1, wherein, when the displaceable die members are in the brought-together position, a space defined by the displaceable die members is elliptical.

12. A forging apparatus as claimed in claim 1, wherein, when the displaceable die members are in the brought-together position, the displaceable die members define a substantially rectangular space.

13. A method of press forging a heated blank, the blank having a volume essentially corresponding to a volume of a final forged component, comprising:

displacing at least one of upper and lower die parts, the die parts including at least one contacting surface extending transversely of a direction of movement of the at least one die part, toward the other one of the die parts to form a closed die cavity;

displacing a mandrel relative to the upper and lower die parts so that the mandrel is received in the closed die cavity and defines an annular gap therewith;

after displacing the mandrel to define the annular gap, continuing to displace the at least one die part to a final position wherein the at least one contacting surface abuts at least one other surface and further displacement of the at least one of the die parts is prevented;

forming a forged component when the at least one die part is displaced to the final position by pressing the blank with the at least one die part so that the blank fills the annular gap.

14. A method as claimed in claim 13, further comprising pretreating the blank to include a closed-bottom by displacing the mandrel so that a bottom end of the mandrel is disposed in a position above a bottom of the closed die cavity and pressing the blank with the at least one die part to fill a space between a bottom of the mandrel and the bottom of the closed die cavity with the blank so that the closed-bottom is formed.

15. A method as claimed in claim 14, comprising performing a final forging operation after the pretreating the blank, the final forging operation including displacing the bottom end of the mandrel to a position removed from the closed bottom and, during the step of forming the forged component, pressing the blank with the at least one die below the bottom end of the mandrel to form a closed upper end.

16. A forging apparatus for forging a heated blank, the blank having a volume substantially corresponding to a volume of a final product, comprising:

a movable first die part, the first die part having a first die cavity forming portion and a first contacting portion;

a second die part, the second die part having a fixed second die cavity forming portion and a second contacting portion;

means for moving the first die part relative to the second die part between an initial position wherein the first contacting portion and the second contacting portion are out of contact with each other and the first die cavity portion and the second die cavity forming portion form an open die cavity in communication with the first contacting portion and the second contacting portion, a final position wherein the first contacting portion and the second contacting portion are in contact with each other and the first die cavity portion and the second die cavity forming portion form at least parts of a closed die cavity wherein communication between the closed die cavity and the first contacting portion and the second contacting portion is closed, and an intermediate position between the initial position and the final position wherein the first contacting portion and the second contacting portion are out of contact with each other and the first die cavity portion and the second die cavity forming portion form at least parts of the closed die cavity;

a cylindrical mandrel extending through one of the first and second die parts and adapted to be received in the closed die cavity; and means for displacing the mandrel relative to the one of the first and second die parts so that the mandrel and the closed die cavity define an annular gap, wherein, during a forging operation, before the moving means moves the first die part to the final position, the displacing means displaces the mandrel so that the mandrel and the closed die cavity define the annular gap, movement of the first die part to the final position causing force to be exerted on the blank to cause the blank to fill the annular gap.

17. A method of press forging for forging a heated blank, the blank having a volume substantially corresponding to a volume of a final product, comprising:

moving a first die part, the first die part having a first die cavity forming portion and a first contacting portion relative to a second die part, the second die part having a second die cavity forming portion and a second contacting portion, from an initial position wherein, in the initial position the first contacting portion and the second contacting portion are out of contact with each other and the first die cavity portion and the second die cavity forming portion form an open die cavity in communication with the first contacting portion and the second contacting portion, to a final position wherein, in the final position, the first contacting portion and the second contacting portion are in contact with each other and the first die cavity portion and the second die cavity forming portion form at least parts of a closed die cavity wherein communication between the closed die cavity and the first contacting portion and the second contacting portion is closed, and passing an intermediate position between the initial position and the final position wherein, in the intermediate position, the first contacting portion and the second contacting portion are out of contact with each other and the first die cavity portion and the second die cavity forming portion form at least parts of the closed die cavity;

before moving the first die part to the final position, displacing a mandrel relative to the first and second die parts so that the mandrel and the closed die cavity define an annular gap; and filling the annular gap with the blank by moving the first die part to the final position.

* * * * *